US009826870B2

(12) United States Patent
Gerth et al.

(10) Patent No.: US 9,826,870 B2
(45) Date of Patent: Nov. 28, 2017

(54) ROBOTIC VACUUM CLEANER

(71) Applicant: Miele & Cie. KG, Guetersloh (DE)

(72) Inventors: Volker Gerth, Bielefeld (DE); Klemens Andrup, Verl (DE); Seyfettin Kara, Spenge (DE); Markus Thamm, Leopoldshoehe (DE); Martin Behrenswerth, Hilter (DE); David Buhl, Bielefeld (DE); Felix Ruetten, Bielefeld (DE); Martin Roth, Bielefeld (DE); Markus Penner, Lage (DE); Carina Uphoff, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 381 days.

(21) Appl. No.: 14/580,317

(22) Filed: Dec. 23, 2014

(65) Prior Publication Data

US 2015/0182087 A1 Jul. 2, 2015

(30) Foreign Application Priority Data

Jan. 2, 2014 (DE) ..... 10 2014 100 006

(51) Int. Cl.
*A47L 9/04* (2006.01)
*A47L 11/40* (2006.01)

(52) U.S. Cl.
CPC ..... *A47L 9/0488* (2013.01); *A47L 9/0411* (2013.01); *A47L 9/0472* (2013.01); *A47L 9/0444* (2013.01);
(Continued)

(58) Field of Classification Search
CPC .... A47L 9/0488; A47L 9/0472; A47L 9/0466; A47L 9/0411; A47L 2201/00; A47L 11/4038; A47L 11/24; E01H 1/0845
(Continued)

(56) References Cited

U.S. PATENT DOCUMENTS

2006/0021168 A1* 2/2006 Nishikawa ..... A47L 9/009 15/49.1
2013/0086760 A1 4/2013 Han et al.
2013/0152332 A1* 6/2013 Jang ..... A47L 9/009 15/319

FOREIGN PATENT DOCUMENTS

EP 2578125 A1 4/2010
EP 2604163 A2 6/2013
(Continued)

OTHER PUBLICATIONS

European Search Report, EP 14 19 6805, European Patent Office, dated May 18, 2015.

*Primary Examiner* — Laura C Guidotti
(74) *Attorney, Agent, or Firm* — Leydig, Voit & Mayer, Ltd.

(57) ABSTRACT

A robotic vacuum cleaner for autonomously cleaning surfaces. The robotic vacuum cleaner comprises an appliance housing and a side arm. The side arm is movably mounted on the appliance housing. A brush element is disposed on the side arm. The side arm projects, in a first position, in front of the appliance housing in part and, in a second position, is received by the appliance housing. The side arm comprising a first arm element having a first end and a second end. The first arm element is movably mounted in the appliance housing at the first end. The side arm comprises a second arm element having a first end and a second end. The second arm element is movably mounted in the appliance housing at the first end and is movably connected to the second end of the first arm element at the second end.

13 Claims, 8 Drawing Sheets

(52) U.S. Cl.
CPC ..... *A47L 11/4038* (2013.01); *A47L 2201/00* (2013.01)

(58) Field of Classification Search
USPC ..... 15/87, 49.1, 50.1
See application file for complete search history.

(56) References Cited

FOREIGN PATENT DOCUMENTS

| | | | |
|---|---|---|---|
| JP | 62292124 | A | 12/1987 |
| JP | 07155273 | A | 6/1995 |
| KR | 20120056354 | A | 6/2012 |

* cited by examiner

ROBOTIC VACUUM CLEANER

CROSS-REFERENCE TO RELATED APPLICATIONS

Priority is claimed to German Patent Application No. DE 10 2014 100 006.4, filed on Jan. 2, 2014, the entire disclosure of which is hereby incorporated by reference herein.

FIELD

The invention relates to a robotic vacuum cleaner for autonomously cleaning surfaces.

BACKGROUND

EP 2 578 125 A1 and EP 2 604 163 A2 disclose the arrangement of a movable side arm on the appliance housing of a robotic vacuum cleaner. At a first end, this side arm is rotationally movably mounted in the appliance housing of the robotic vacuum cleaner. At least one brush element is arranged on a second end of the side arm which is largely opposite the first end. In a first position of the side arm, the second end thereof projects in front of the appliance housing of the robotic vacuum cleaner. The brush element arranged on the projecting end of the side arm makes it possible to clean those regions of a surface that cannot be reached or can only be unsatisfactorily reached by the suction mouth of the robotic vacuum cleaner. Particles of dust and dirt are reliably removed in particular from corner and edge regions of a surface to be cleaned.

This is problematic in that the movable side arms project, in a first position, in front of the appliance housing of the robotic vacuum cleaner such that there is a gap between the side arms and the appliance housing. In this case, the gap is produced between the appliance housing and the side of the side arm that is at the rear relative to the main movement direction of the robotic vacuum cleaner. Objects on the surface to be cleaned, for example cables or wires, may become caught in this gap during an autonomous cleaning operation of the robotic vacuum cleaner. The objects that have become caught generally prevent the cleaning operation from continuing autonomously, and often make it necessary for the user to manually remove the objects from the side arms, which is laborious. In addition, in regions having particularly complex layouts, projecting edges may become stuck in the gap between the appliance housing and the side arm. The robotic vacuum cleaner which has become stuck in this way cannot then autonomously continue the cleaning operation and needs to be manually released by the user.

SUMMARY

In an embodiment, the present invention provides a robotic vacuum cleaner for autonomously cleaning surfaces. The robotic vacuum cleaner comprises an appliance housing and a side arm. The side arm is movably mounted on the appliance housing. A brush element is disposed on the side arm. The side arm projects, in a first position, in front of the appliance housing in part and, in a second position, is received by the appliance housing. The side arm comprising a first arm element having a first end and a second end. The first arm element is movably mounted in the appliance housing at the first end. The side arm comprises a second arm element having a first end and a second end. The second arm element is movably mounted in the appliance housing at the first end and is movably connected to the second end of the first arm element at the second end.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
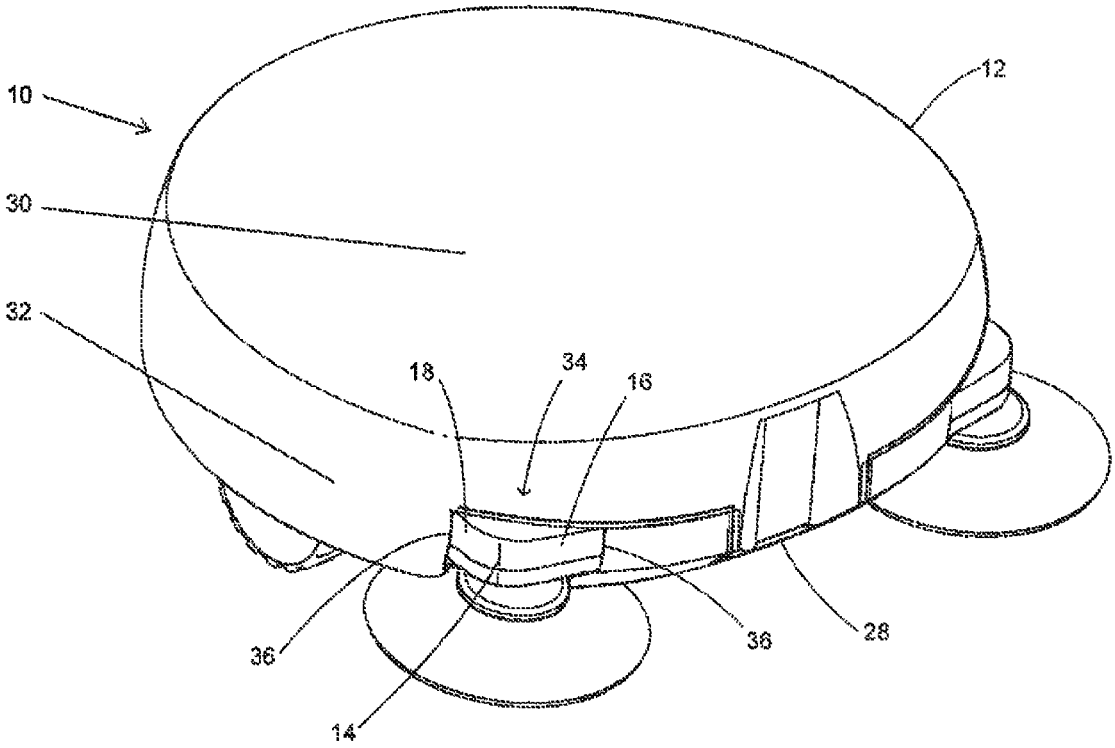
FIG. 1 is a perspective view of a robotic vacuum cleaner.

An aspect of the invention provides a robotic vacuum cleaner comprising side arms for the improved cleaning of edge and corner regions and of thereby overcoming the above-mentioned drawbacks. In an embodiment, the present invention comprises an appliance housing and at least one side arm which is movably mounted in or below the appliance housing and on which at least one brush element is arranged, the at least one side arm projecting, in a first position, in front of the appliance housing in part and, in a second position, being received by the appliance housing, the at least one side arm comprising a first arm element having a first end and a second end, the first end of the first arm element being opposite the second end, the first arm element being movably mounted in the appliance housing at the first end.

The robotic vacuum cleaner for autonomously cleaning surfaces is distinguished in that the side arm comprises a second arm element having a first end and a second end, the first end being opposite the second end, the second arm element being movably mounted in the appliance housing at the first end and being movably connected to the second end of the first arm element at the second end. The side arm thus comprises at least two individual arm elements which are both movably mounted in the appliance housing of the robotic vacuum cleaner at respective first ends, and the respective second ends thereof are interconnected. In this case, the two arm elements are in particular rod-shaped. The first and the second end of the first arm element are at an approximately maximum distance from each other relative to the length of the first arm element. The first and the second end of the second arm element are at an approximately maximum distance from each other relative to the length of the second arm element. The first ends of the two arm elements are mounted at different points in the appliance housing of the robotic vacuum cleaner. In an alternative embodiment, however, it is also conceivable for the first ends of both arm elements to be mounted at the same point in the appliance housing of the robotic vacuum cleaner. In this case, the first ends of the two arm elements are mounted in the appliance housing of the robotic vacuum cleaner in different manners. In an alternative embodiment, however, it is also conceivable for the first ends of both arm elements to be mounted in the appliance housing of the robotic vacuum cleaner in an identical manner. The two arm elements are flexibly interconnected at the second ends, which can project in front of the appliance housing of the robotic vacuum cleaner. In particular, the connection between the first arm element and the second arm element at the second ends of the first and the second arm element can project in front of the appliance housing of the robotic vacuum cleaner. In an alternative embodiment, however, it is also conceivable to movably interconnect the two arm elements at other points on the arm elements.

By arranging a second arm element of which a first end is mounted in the appliance housing and of which a second end is connected to the second end of the first arm element of the side arm, a gap between the rear side of the side arm and the appliance housing is eliminated. In this way, objects which are on the surface to be cleaned cannot become caught between the side arm and the appliance housing and thus lead to the autonomous cleaning operation of the robotic vacuum cleaner being interrupted. In this way, edges of particularly complex room layouts cannot become stuck between the side arm and the appliance housing and thus lead to the robotic vacuum cleaner becoming stuck and to the cleaning operation being interrupted.

A robotic vacuum cleaner is preferred in which the second arm element is slidingly mounted in the appliance housing at the first end. In this case, the receiving portion for mounting the first end of the second arm element in the appliance housing is formed such that the second arm element is received in an approximately linearly guided manner. This linear guidance limits the movement of the second arm element to a determined or determinable movement range. In this case, the direction of the linear guidance to the receiving portion for the second arm element in the appliance housing substantially corresponds to the main movement direction of the robotic vacuum cleaner. In this embodiment, the first end of the first arm element is rotationally movably mounted in the appliance housing of the robotic vacuum cleaner. In an alternative embodiment, however, it is conceivable to rotationally movably mount the first end of the second arm element in the appliance housing and to slidingly mount the first end of the first arm element in the appliance housing. In further alternative embodiments, additional mounting combinations for the respective first ends of both arm elements are conceivable, for example slidingly mounting both arm elements.

Slidingly receiving the first end of the second arm element makes it possible to move the side arm in a guided manner both into a first position in which the side arm largely projects in front of the appliance housing of the robotic vacuum cleaner in plan view and into a second position in which the side arm is almost completely received by the appliance housing. By means of the side arm projecting in front of the appliance housing in the first position, the cleaning power of the robotic vacuum cleaner is significantly improved, in particular in edge and corner regions. The side arm is simultaneously received by the appliance housing in a second position such that the robotic vacuum cleaner cannot become stuck on objects or edges on the surface to be cleaned during an autonomous cleaning operation.

In a preferred embodiment, a pin which is slidingly mounted in a receiving portion in the appliance housing is arranged on the first end of the second arm element. For this purpose, a pin is inserted into an opening at the first end of the second arm element, which pin is received in the appliance housing of the robotic vacuum cleaner by receiving elements. In this case, the pin is inserted into the second arm element in a vertical position and is connected thereto. In alternative embodiments, however, it is also conceivable to arrange the pin on the arm element in a horizontal position. The receiving elements for the pin in the appliance housing of the robotic vacuum cleaner are arranged both above and below the arm element. In an alternative embodiment, however, it is also conceivable to arrange the receiving elements in the appliance housing to the side of the arm element. In addition, in another alternative embodiment it is conceivable to arrange the receiving elements in the appliance housing of the robotic vacuum cleaner on only one side of the arm element.

Arranging a pin for slidingly receiving the first end of the second arm element is a reliable and robust way of mounting the arm element. In particular, arranging receiving elements on two sides in the appliance housing ensures that the side arm is mounted robustly and resiliently so as to be capable of withstanding the forces occurring on the side arm. This prevents the side arm from becoming detached from its mounting in the appliance housing owing to the forces occurring during a cleaning operation.

It is preferable for both arm elements to be interconnected at the second ends via a shaft. In this case, the connection between the second ends of the first and the second arm element is configured such that it makes it possible for the two arm elements to move relative to each other. In this case, the shaft is arranged vertically on the second ends of the two arm elements. In an alternative embodiment, however, it is also conceivable for the two arm elements to be interconnected at the second end thereof via a joint or a hinge. In another alternative embodiment of the side arms, however, it is also conceivable for the two arm elements to be interconnected via a rigid, stationary connection.

The movable connection between the two arm elements via a shaft allows the largest possible movement radius of the side arms, while, simultaneously, the available installation space in the appliance housing of the robotic vacuum cleaner is efficiently utilised. As a result, the side arm can project, in a first position and in plan view, sufficiently far in front of the appliance housing of the robotic vacuum cleaner to improve the cleaning power thereof, in particular in edge and corner regions. It is simultaneously ensured that the side arm occupies as little installation space as possible in a second position in which it is almost completely received by the appliance housing. In addition, movably connecting the arm elements makes it easier to mount the side arm in the appliance housing of the robotic vacuum cleaner.

In addition, it is preferable that the shaft between the first arm element and the second arm element simultaneously functions as a rotary shaft of the brush element. For this purpose, a brush element is also arranged below the side arm, facing the surface to be cleaned, on the shaft which connects the two arm elements. This means that the shaft which movably interconnects the first and the second arm element is used as a rotary shaft of the brush element and connects said element to the side arm of the robotic vacuum cleaner simultaneously. In an alternative embodiment, however, it is also conceivable to arrange the rotary shaft of the brush element on the side arm independently of the shaft which interconnects the two arm elements.

Simultaneously designing the shaft which interconnects the first and the second arm element as a rotary shaft of the brush element simplifies the construction of the side arm and reduces the production complexity thereof In addition, by centrally arranging the rotary shaft of the brush element between the two arm elements, the forces acting on the brush element during a cleaning operation are approximately evenly distributed over the two arm elements of the side arm and thus also over the bearings thereof in the appliance housing. This ensures an evenly guided movement of the side arms between the first and the second position and also prevents individual bearings from being overloaded on one side.

A robotic vacuum cleaner is preferred in which the rotational movement of the first arm element has, by means of limiting elements, an angular range of from 2 to 70 degrees in a preferred embodiment and an angular range of from 5 to 30 degrees in a particularly preferred embodiment. In a plan view of the appliance housing, the angular range is enclosed between a straight line which is on the outside of the appliance housing of the robotic vacuum cleaner and substantially transverse to the main movement direction thereof and a side of the first arm element which is arranged in the main movement direction of the robotic vacuum cleaner. In the first position of the side arm, in which said arm projects in front of the appliance housing at least in part, an angle of 2 degrees is produced in a preferred embodiment and, in a particularly preferred embodiment, an angle of 5 degrees is produced between the straight line and the side of the first arm element which is arranged in the main movement direction of the robotic vacuum cleaner. In the second position of the side arm, in which the side arm is almost completely received by the appliance housing, an angle of 70 degrees is produced in a preferred embodiment and, in a particularly preferred embodiment, an angle of 30 degrees is produced between the straight line and the side of the first arm element which is arranged in the main movement direction of the robotic vacuum cleaner. The rotational movement of the at least one side arm is limited by elements arranged in the appliance housing.

Limiting the rotational movement of the at least one side arm to the claimed angular range causes the side arm to project to a sufficient extent in front of the appliance housing in the first position. As a result, the brush element arranged below the side arm cleans particles of dust and dirt from edge and corner regions which would not be picked up by the suction mouth arranged below the appliance housing or would only be picked up to a limited extent. The claimed angular range is also selected such that the side arm can be almost completely received by the appliance housing in the second position.

It is preferable that, if the at least one side arm is arranged in the first position, the two arm elements of the side arm and the two edges of the at least one opening in the side wall are approximately flush with one another. This means that, in the first position, the at least one side arm is arranged such that no gaps arise between the appliance housing and both arm elements of the side arm. For this purpose, the opening in the side wall of the appliance housing is coordinated with the structural geometry of the side arm such that the dimensions of the gap between the two arm elements and the appliance housing in the first position of the side arm do not exceed technical minimum dimensions required for the movability of the arm elements.

Since gaps between the arm elements and the appliance housing in the first position of the side arm are largely prevented, it is ensured that objects on the surface to be cleaned, for example cables or wires, cannot become caught or stuck on the side arm. This increases the autonomy of the robotic vacuum cleaner, since it is not necessary for the user to manually and laboriously remove objects caught on the side arm. In addition, a projecting corner or edge of the floor surface to be cleaned can be prevented from becoming stuck in the gaps between the side arm and the appliance housing and thus leading to the cleaning operation being interrupted. In particular in rooms having complex layouts, the robotic vacuum cleaner can be prevented from becoming stuck in corner or edge regions because of the projecting side arms in the first position.

In a preferred embodiment, the at least one side arm is spring-loaded towards the first position outside the appliance housing. This means that the at least one side arm is pushed or pulled towards the first position by the force of a spring element. In an alternative embodiment, a leg spring arranged in the first arm element spring-loads the side arm towards the first position. In this case, the leg spring is arranged in the first arm element on the rotary shaft thereof which connects the arm element to the appliance housing via a shaft. The legs of the spring element are surrounded by the walls of the first arm element or by delimiting elements which are arranged in the appliance housing and engage in the first arm element of the side arm through an opening.

The use of spring force for moving the side arm out of the appliance housing is a cost-effective, compact and reliable solution. As a result, additional motor elements for retracting and extending the at least one side arm are not required. Owing to the limited battery capacities of robotic vacuum cleaners, this has the effect of lengthening the cleaning operations of the robotic vacuum cleaner. The use of a leg spring is particularly advantageous since, by using this, the rotational movement of the side arm can be adjusted with relatively little technical complexity.

In addition, it is preferable for the spring force acting on the at least one side arm to have a force of between 0.5 and 10 newtons in a preferred embodiment and a force of between 1.5 and 4 newtons in a particularly preferred embodiment.

In this case, the spring force acting on the side arm is specified such that the force is sufficient to hold the side arms in the first position outside the appliance housing in unobstructed operation. In this case, 'unobstructed operation' is understood to mean a normal cleaning operation in which neither the side arm nor the brush element arranged on the side arm come into contact with corners, edges or objects on the surface to be cleaned. For this purpose, the spring force has to be greater than the force resulting from the friction or the engagement of the brush elements in the floor covering to be cleaned and acting on the side arm counter to the direction of travel of the robotic vacuum cleaner. In particular on high-pile floor coverings, it needs to be ensured that the side arms are not pushed out of the first position and into the second position solely by the resistance of the floor covering as the robotic vacuum cleaner moves forward. In this case, the spring force acting on the side arm simultaneously has to be selected such that the side arms can be pushed into the appliance housing by objects, edges or corners on the surface to be cleaned with little force. This prevents the side arms of the robotic vacuum cleaner from tilting or becoming stuck on objects, edges or corners on the surface to be cleaned.

It is preferable for the motor to function as a drive for the brush element of the side arm via a toothed belt, a first pulley and a second pulley which are arranged within the first arm element. This means that, in the first arm element, a first pulley is arranged on the rotary shaft of the brush element and is operatively connected, via a toothed belt, to a second pulley arranged in the first arm element. The second pulley is driven by the motor arranged on the outside of the first arm element. In an alternative embodiment, it is conceivable to arrange the motor within the first arm element and to drive the brush element by means of at least one transmission element which is likewise arranged within the first arm element. In another alternative embodiment, it is conceivable to arrange the motor on the outside of the second arm element and for the motor to function as a drive for the brush element of the side arm via a toothed belt, a first pulley and a second pulley which are arranged within the second arm element.

Arranging the motor, the toothed belt and the two pulleys within the first arm element makes it possible to transmit the drive power from the motor to the brush element directly and mostly without losses. In addition, by largely integrating the drive elements into the first arm element, the movability of the side arm is not limited by additional mechanical connection elements between the appliance housing and the side arm. This would be necessary if a motor for driving the brush element were arranged in the appliance housing and the drive power thereof had to be transmitted from the appliance housing into the side arm via at least one transmission element.

An embodiment of the invention is shown in a purely schematic manner in the drawings and will be described in greater detail below. Subjects or elements corresponding to one another are provided with the same reference numerals in all the drawings. The or each embodiment should not be understood as a restriction of the invention. Rather, amendments and modifications are also possible within the scope of the present disclosure which can be inferred by a person skilled in the art with regard to solving the problem by the combination or amendment of individual features or method steps in conjunction with those described in the general or specific part of the description and in the claims and/or the drawings, and lead to new subject matter or new method steps by way of combinable features.

FIG. 1 shows a robotic vacuum cleaner 10 for autonomously cleaning surfaces, in particular floor surfaces. The robotic vacuum cleaner 10 comprises an appliance housing 12 made up of an upper side and an underside 30, 28, both having an approximately round base, and a side wall 32 connecting an upper side and underside 28, 30. A travel drive 50 is arranged on the underside 28 of the appliance housing 12, which drive is capable of moving the robotic vacuum cleaner 12 on the surface to be cleaned. Two openings 34 are arranged laterally in the side wall 32 in the front region of the robotic vacuum cleaner 10 relative to the main movement direction of the robotic vacuum cleaner 10. These openings 34 are approximately rectangular and are each laterally defined by two edges 36. Two side arms 14 are arranged in the openings 34 in the side wall 32 of the robotic vacuum cleaner 10. The side arms 14 are movably mounted in the appliance housing 12 of the robotic vacuum cleaner 10 and project outwards out of the appliance housing 12 in the position shown. Rotatable brush elements 24 are arranged below the side arms 14, which elements are in direct contact with the floor surface to be cleaned.

Figure 2:
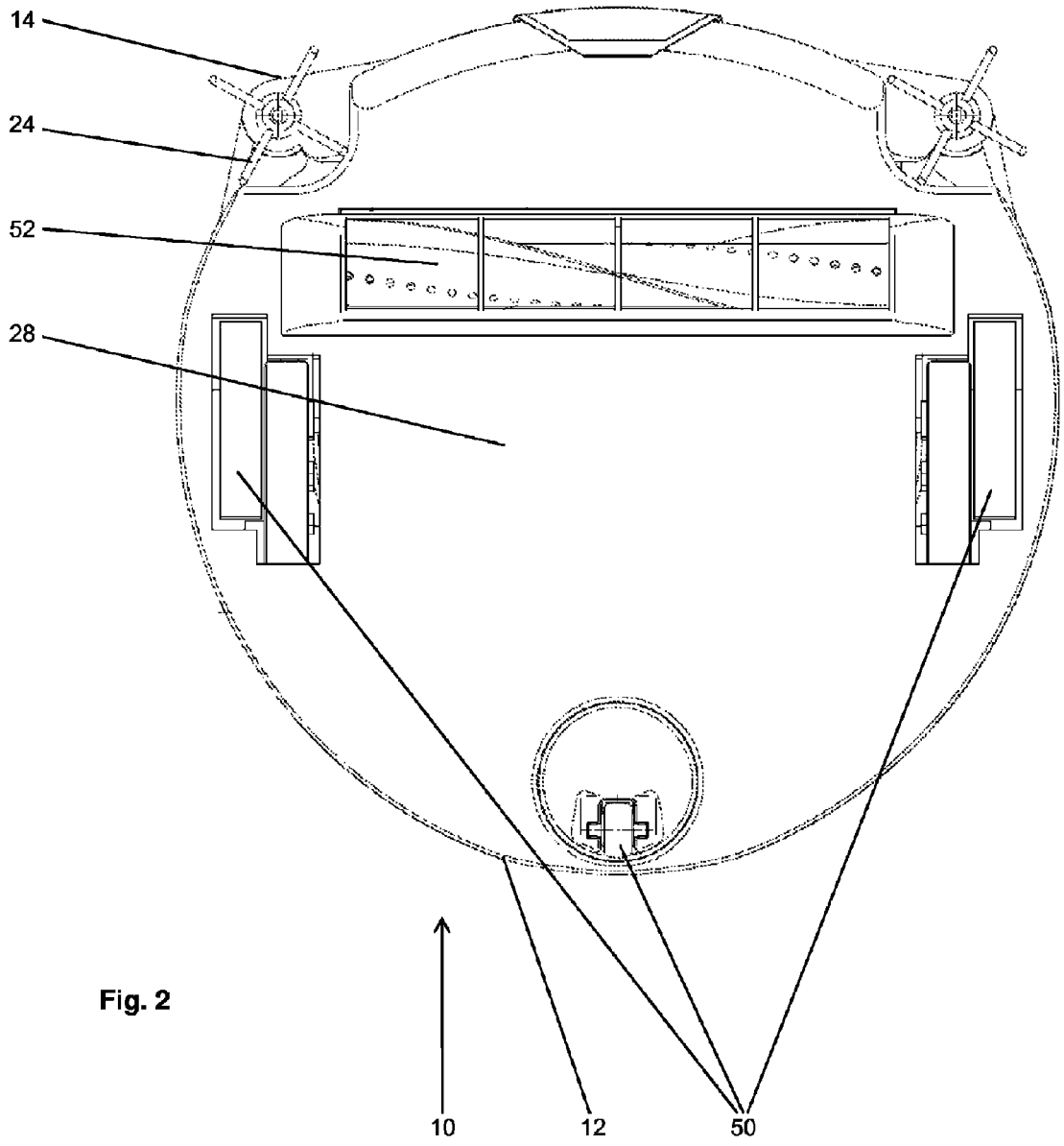
FIG. 2 is a bottom view of a robotic vacuum cleaner comprising side arms.

FIG. 2 is a bottom view of a robotic vacuum cleaner 10 which has an appliance housing 12 having an approximately round basic shape. The robotic vacuum cleaner 10 comprises a travel drive 50 in the rear region and in the central region close to the edge, relative to the main movement direction of said robotic vacuum cleaner. A suction opening 52 is arranged on the underside 28 of the robotic vacuum cleaner 10 in front of the elements of the travel drive 50 which are arranged in the central region of the robotic vacuum cleaner 10. This suction opening 52 has a rectangular basic shape and extends approximately over the entire width of the appliance housing 12. Two side arms 14 are arranged in front of the suction opening 52 on the two outer edges thereof, relative to the main movement direction of the robotic vacuum cleaner 10. The two side arms 14 are shown in a first position in which the side arms 14 project outwards at least in part from the approximately round basic shape of the appliance housing 12. Rotatable brush elements 24 which are in direct contact with the floor surface to be cleaned are arranged below both side arms 14.

Figure 3:
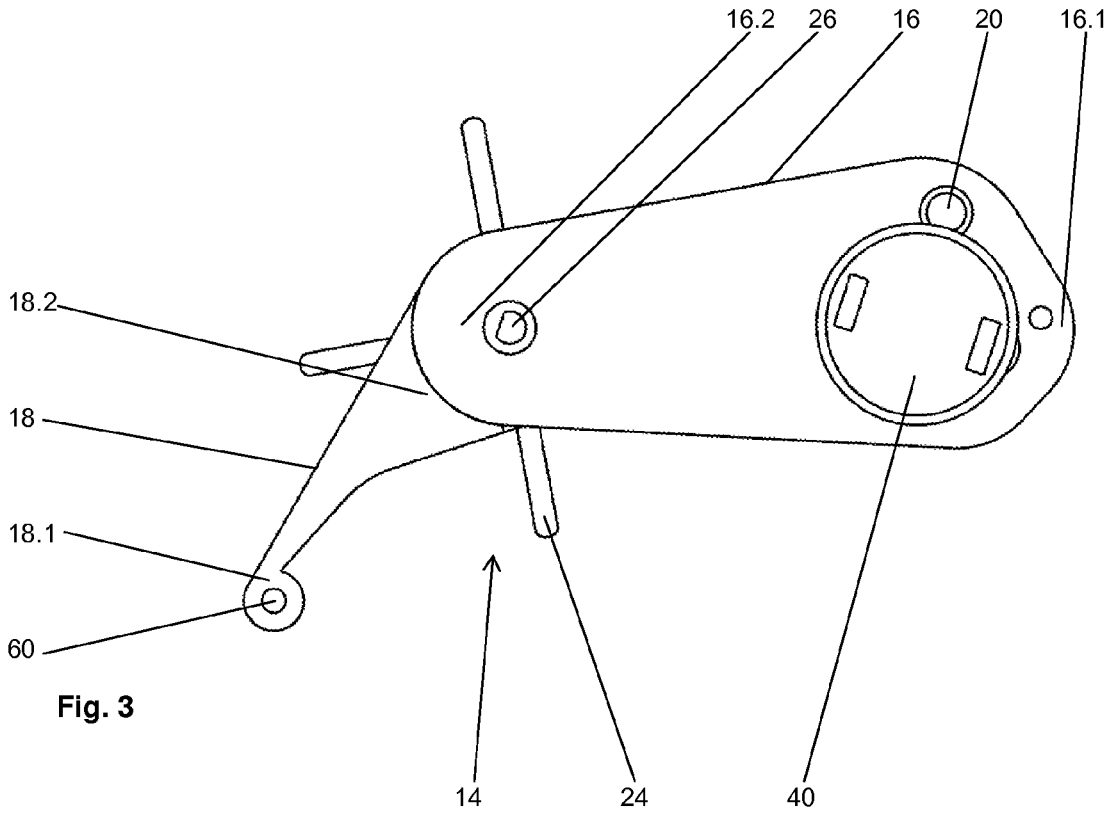
FIG. 3 is a plan view of a side arm.

FIG. 3 is a plan view of a side arm 14 which comprises a first and a second arm element 16, 18. In plan view, the first arm element 16 has a basic shape that is similar to a rod, comprising a first end 16.1 that is substantially opposite a second end 16.2. In plan view, the first arm element 16 has a somewhat wider basic shape at the first end 16.1 and tapers towards the second end 16.2. On the first end 16.1 of the first arm element, a motor 40 is placed onto the arm element 16 from above. In plan view, the motor 40 has a round basic shape and is approximately centrally arranged on the first arm element 16. The rotary shaft 20 of the side arm 14 is arranged on the first end 16.1 of the first arm element 16, above the motor 40. The first arm element 16 of the side arm 14 is rotatably mounted in the appliance housing 12 of the robotic vacuum cleaner 10 via said shaft 20. The rotary shaft 26 of the brush element 24 is centrally arranged on the second end 16.2 of the first arm element 16 such that it is arranged below the side arm 14 and rests on the surface to be cleaned.

At the second end 16.2, the first arm element 16 is connected to the second end 18.2 of the second arm element 18 via the rotary shaft 26. The second arm element 18 also has an approximately rod-shaped basic shape, having a first end 18.1 and a second end 18.2 which is opposite the first end 18.1. In plan view, the second end 18.2 of the second arm element 18 has an approximately identical shape to the second end 16.2 of the first arm element 16. In plan view, said second end tapers between the first 18.1 and the second 18.2 end of the second arm element 18 to a basic shape that is considerably narrower than the first end 16.1 of the first arm element 16. An opening is centrally arranged at the first end 18.1 of the second arm element 18, in which opening a pin 60 is centrally arranged. By means of this pin 60, the first end 18.1 of the second arm element 18 is linearly slidingly mounted in the appliance housing 12 of the robotic vacuum cleaner 10.

Figure 4:
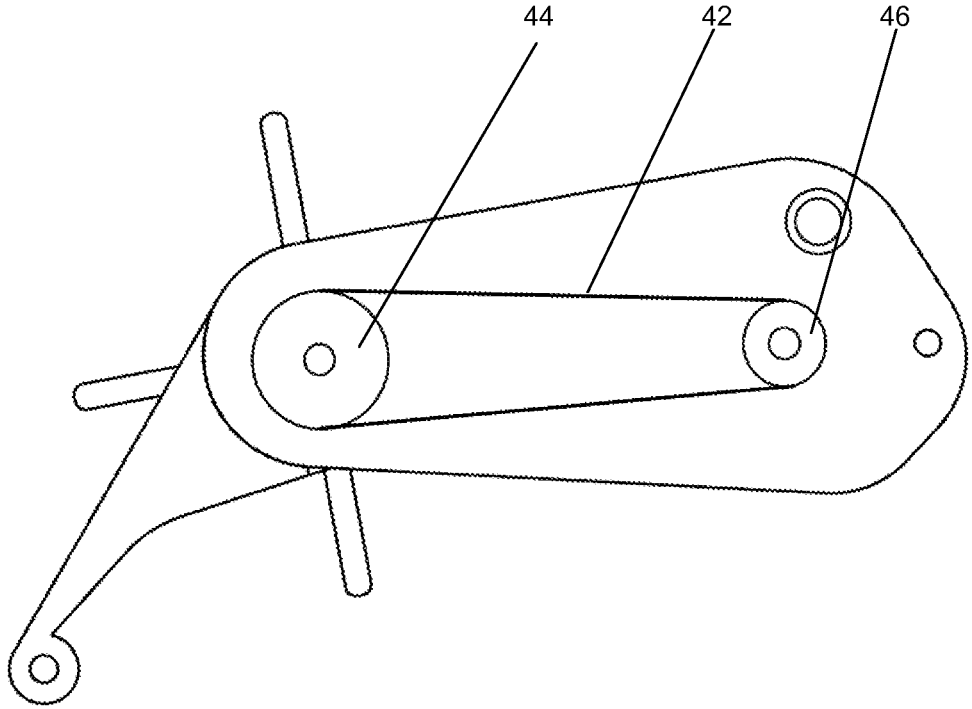
FIG. 4 shows drive elements of a side arm.

FIG. 4 is a section through a side arm 14 which comprises a first and a second arm element 16, 18. In this view, the first arm element 16 has a basic shape that is similar to a rod, comprising a first end 16.1 that is substantially opposite a second end 16.2. At the first end 16.1 of the first arm element 16, a second pulley 46 is centrally arranged in the arm element 16. This pulley 46 is directly operatively connected to a motor 40 which is placed onto the first arm element 16 from above, The second pulley 46 is surrounded in part by a toothed belt 42 which connects the second pulley 46 to a first pulley 44. In the first arm element 16, the first pulley 44 is centrally arranged on the rotary shaft 26 of the brush element 24 which is arranged on the second end 16.2 of the first arm element 16. The first pulley 44 is also surrounded at least in part by the toothed belt 42, Which is arranged completely within the first arm element 16.

Figure 5:
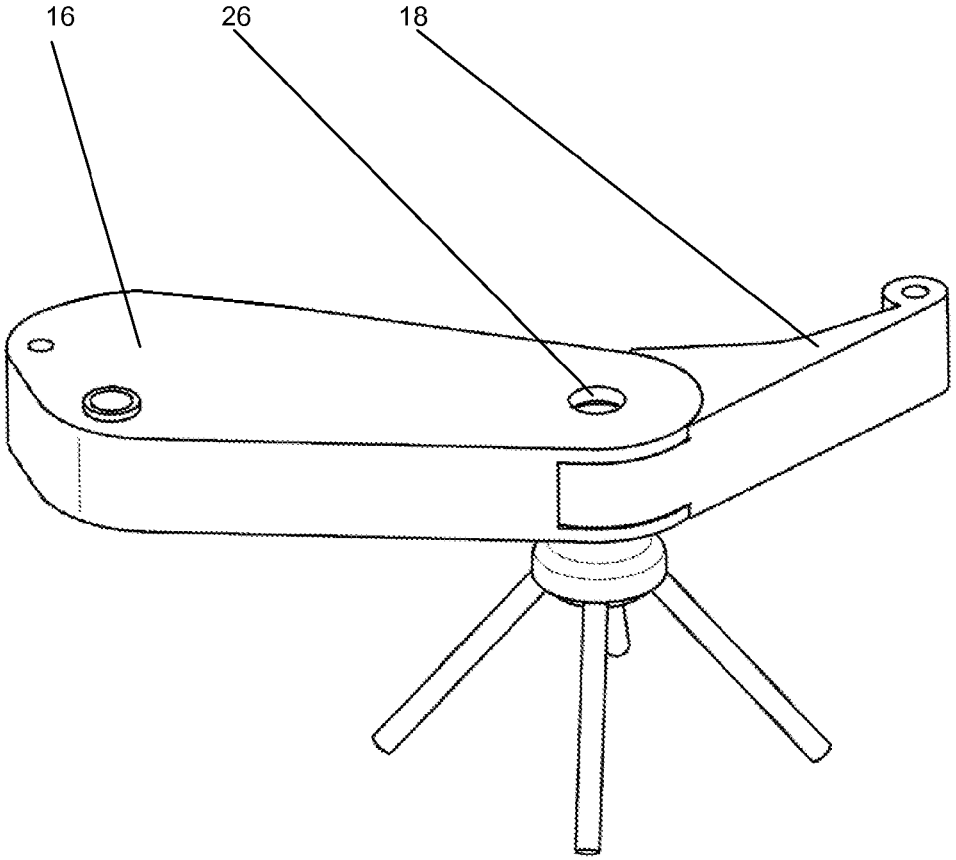
FIG. 5 is a perspective view of a side arm.

FIG. 5 is a perspective view of a side arm 14 which comprises a first and a second arm element 16, 18. The first arm element 16 comprises a first and a second end 16.1, 16.2 which are substantially opposite each other. On the first end 16.1 of the first arm element 16, the rotary shaft 20 of the side arm 14 is arranged in the region of the first arm element 16 that is at the front relative to the main movement direction of the robotic vacuum cleaner 10. The first arm element 16 is rotatably mounted in the appliance housing 12 of the robotic vacuum cleaner 10 via said shaft 20. A recess which receives the second end 18.2 of the second arm element 18 at least in part is provided on the second end 16.2 of the first arm element 16. A hole which is capable of receiving a shaft 26 which connects the first and the second arm element 16, 18 is centrally provided on the second ends 16.2, 18.2 of the first and the second arm elements 16, 18. Said shaft 26 simultaneously functions as a rotary shaft of the brush element 24, which is arranged below the side arm 14.

Figure 6:
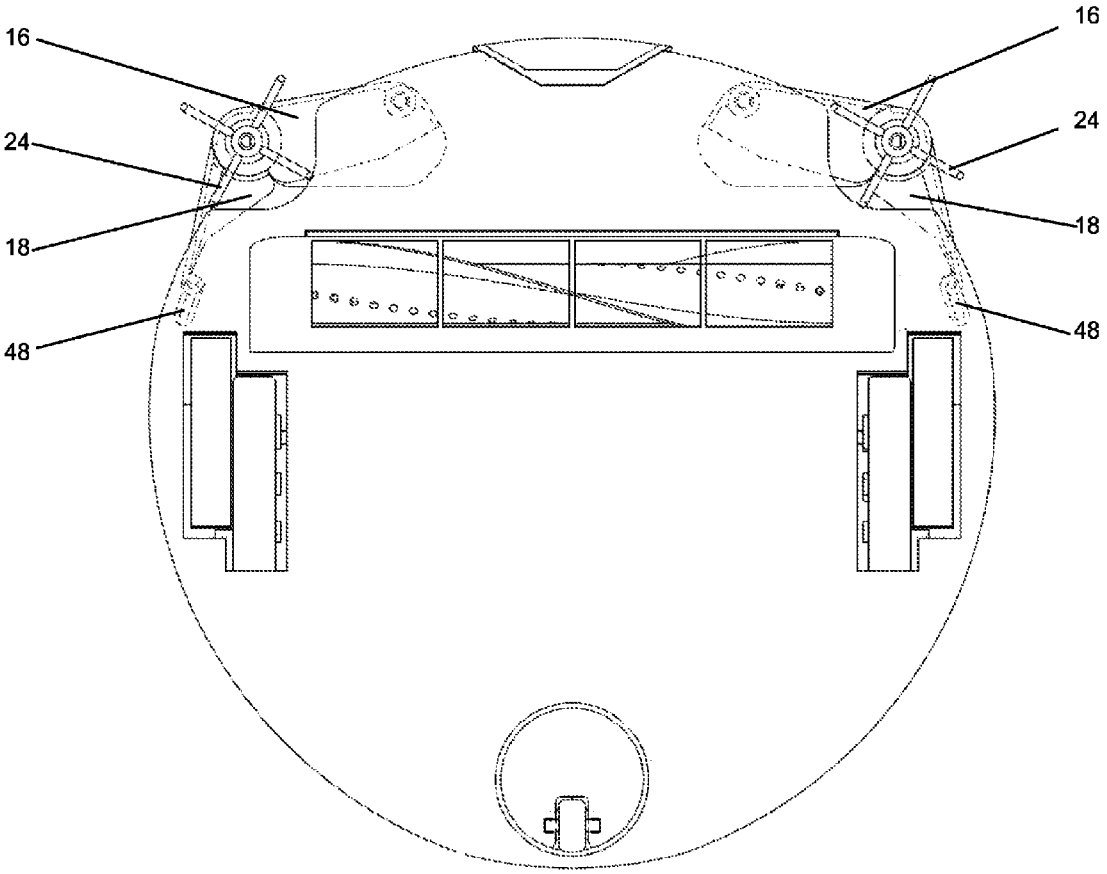
FIG. 6 is a bottom view of a robotic vacuum cleaner having folded-out side arms.

FIG. 6 is a bottom view of a robotic vacuum cleaner 10 which comprises an appliance housing 12 in which a side arm 14 is arranged on either side in the region that is at the front relative to the main movement direction of the robotic vacuum cleaner 10. Both side arms 14 comprise a first arm element 16 and a second arm element 18. At a first end 16.1, the first arm element 16 is mounted in the front region of the appliance housing 12 so as to rotate about a shaft 20. At a first end 18.1, the second arm element 18 is linearly slidingly mounted in a receiving portion 48 in the appliance housing 12, which portion is arranged laterally beside the suction mouth 52 on the edge of the appliance housing 12. At the second ends 16.2, 18.2 of the first and the second arm elements 16, 18, said arm elements are movably interconnected via a shaft 26. In this case, this shaft 26 simultaneously functions as a rotary shaft 26 of the brush element 24 that is arranged below the side arm 14. FIG. 6 shows both side arms 14 in a first position in which, in plan view, they project in front of the appliance housing 12 of the robotic vacuum cleaner 10 at least in part. In particular, the brush elements 24 arranged below the side arms 14 project almost completely in front of the appliance housing 12 of the robotic vacuum cleaner 10 in this first position in plan view.

Figure 7:
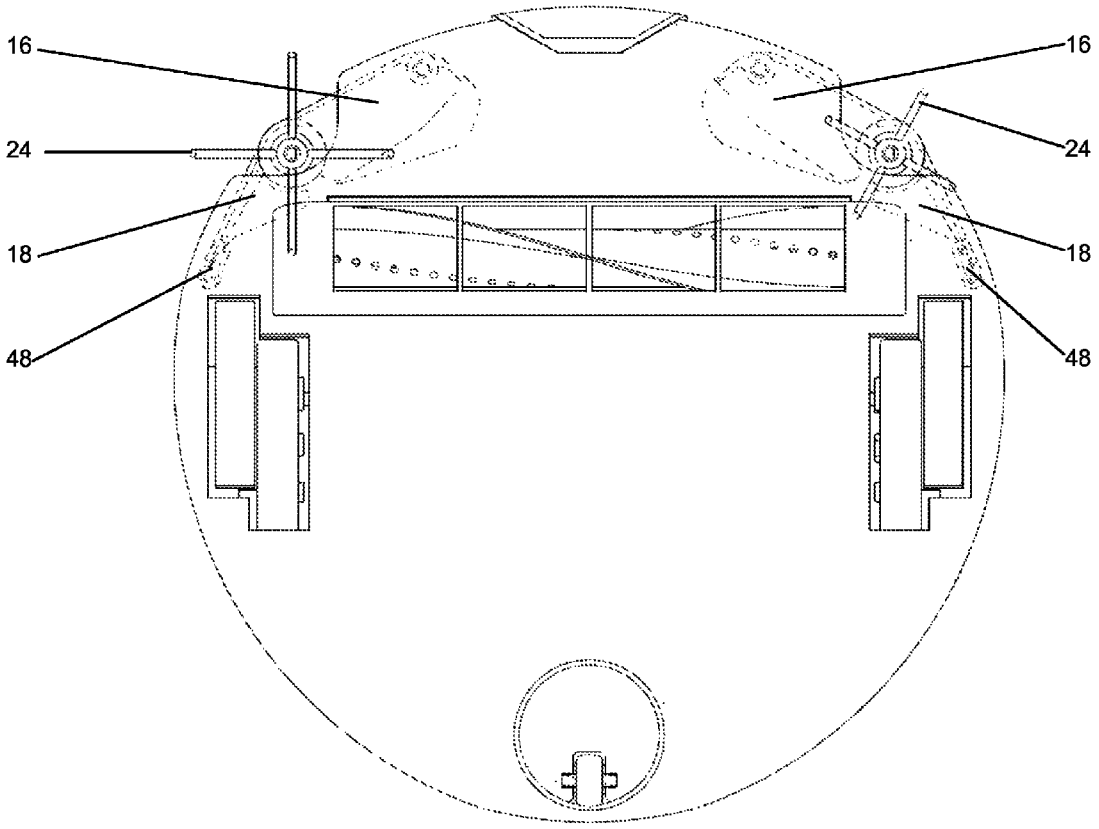
FIG. 7 is a bottom view of a robotic vacuum cleaner having retracted side arms.

FIG. 7 is a bottom view of a robotic vacuum cleaner 10 which comprises an appliance housing 12 in which a side arm 14 is arranged on either side in the region that is at the front relative to the main movement direction of the robotic vacuum cleaner 10. Both side arms 14 comprise a first arm element 16 and a second arm element 18. At a first end 16.1, the first arm element 16 is mounted in the front region of the appliance housing 12 so as to rotate about a shaft 20. At a first end 18.1, the second arm element 18 is linearly slidingly mounted in a receiving portion 48 in the appliance housing 12, which portion is arranged laterally beside the suction mouth 52 on the edge of the appliance housing 12. At the second ends 16.2, 18.2 of the first and the second arm elements 16, 18, said arm elements are movably interconnected via a shaft 26. In this case, this shaft 26 simultaneously functions as a shaft 26 of the brush element 24 that is arranged below the side arm 14. FIG. 7 shows both side arms 14 in a second position in which said arms are received, in plan view, almost completely by the appliance housing 12 of the robotic vacuum cleaner 10. In particular, the brush elements 24 arranged below the side arms 14 are almost completely covered by the appliance housing 12 of the robotic vacuum cleaner 10 in this second position in plan view.

Figure 8:
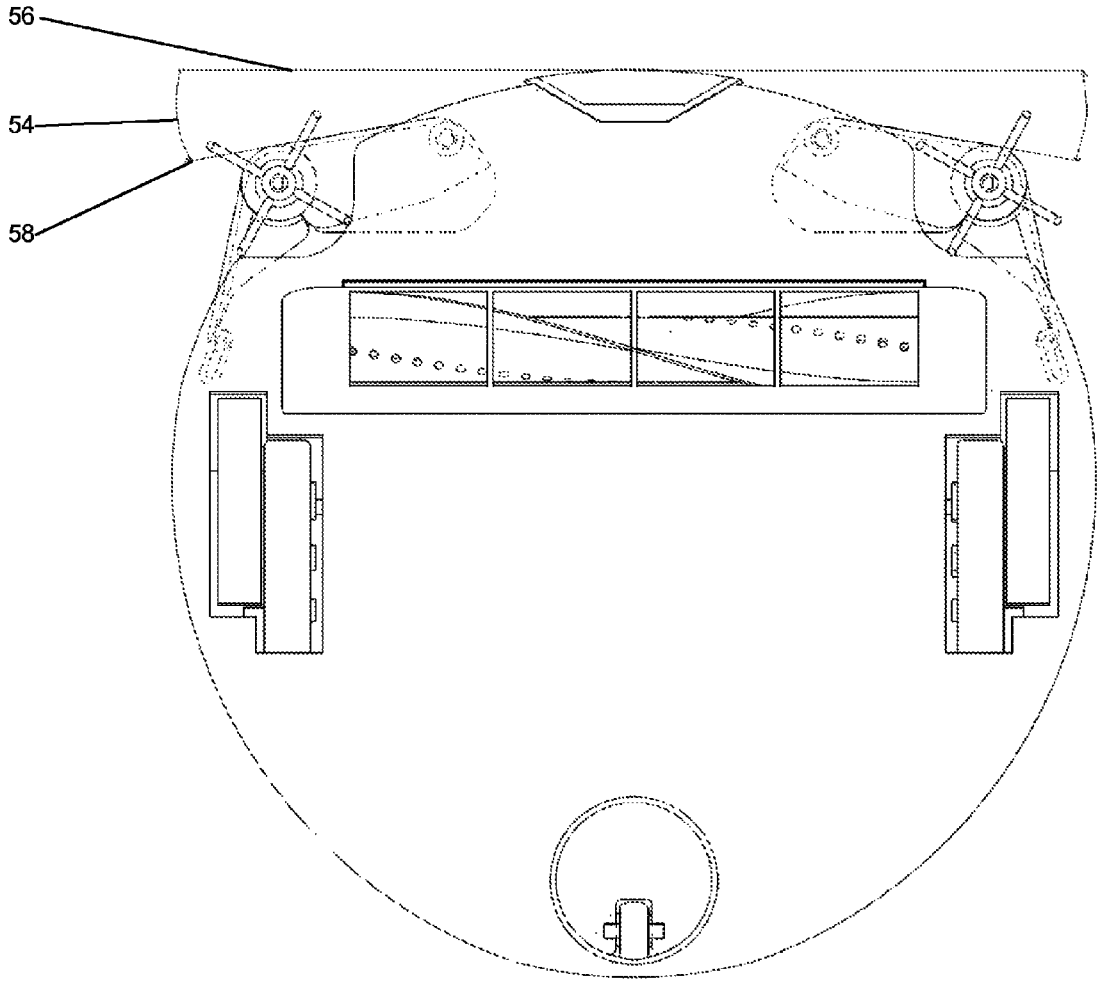
FIG. 8 shows the fold-out angle of the side arms of a robotic vacuum cleaner.

FIG. 8 is a bottom view of a robotic vacuum cleaner 10 which has an appliance housing 12 having an approximately round basic shape. The robotic vacuum cleaner 10 comprises elements 50 of a travel drive close to the edges in the rear and central region, relative to the main movement direction. A suction mouth 52 is arranged on the underside 28 of the robotic vacuum cleaner 10, in front of the elements 50 of the travel drive which are arranged in the central region of the robotic vacuum cleaner 10. The suction mouth 52 has a rectangular basic shape and extends approximately over the entire width of the appliance housing 12. Two side arms 14 are arranged on the two outer edges of the suction mouth 52 in front of said mouth, relative to the main movement direction of the robotic vacuum cleaner 10. Said side arms 14 each comprise a first arm element 16 and a second arm element 18. The first arm elements 16 of the two side arms 14 are, at the first ends 16.1 thereof, rotatably mounted in the appliance housing 12 via shafts 20 on sides opposite the suction mouth 52. At the second ends 16.2 of the first arm elements 16, said elements are movably connected to the second ends 18.2 of the second arm elements 18. At the first ends 18.1, the two second arm elements 18 are linearly slidingly received in the appliance housing 12. The receiving portion 48 for the first ends 18.1 of the second arm elements 18 is arranged at the edge, beside the suction mouth 52 of the appliance housing 12. A rotatable brush element 24 is arranged below the point at which the second ends 16.2, 18.2 of the first and the second arm elements 16, 18 are interconnected. In this case, the brush element 24 is arranged below the side arm 14 such that said element 24 rests at least in part on the surface to be cleaned.

On the appliance housing 12, two side arms 14 are shown in a first position in which the side arms 14 reach a determined or determinable fold-out angle 54. The fold-out angle 54 of a side arm is enclosed between a first straight line 56 which is on the outside of the appliance housing 12 and approximately transverse to the main movement direction of the robotic vacuum cleaner 10 and a second straight line 58 which is on the side of the first arm element 16 of the side arm 14 opposite the suction mouth 52. The shown position of the side arms 14 having the resulting fold-out angle 54 approximately corresponds to the maximum preferred fold-out angle 54 of a side arm 14.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 Robotic vacuum cleaner
12 Appliance housing
14 Side arm
16 First arm element
16.1 First end
16.2 Second end
18 Second arm element
18.1 First end
18.2 Second end
20 Rotary shaft of side arm
22 Shaft
24 Brush element
26 Rotary shaft of brush element
28 Underside of appliance housing
30 Upper side of appliance housing
32 Side wall of appliance housing
34 Opening in side wall
36 Edges of the opening
38 Limiting elements
40 Motor
42 Toothed belt
44 First pulley
46 Second pulley
48 Receiving portion in appliance housing
50 Travel drive
52 Suction mouth
54 Fold-out angle of side arm
56 First straight line
58 Second straight line
60 Pin

The invention claimed is:

1. A robotic vacuum cleaner for autonomously cleaning surfaces, the robotic vacuum cleaner comprising:
an appliance housing; and
at least one side arm which is movably mounted at least one of in or below the appliance housing and on which at least one brush element is disposed, the at least one side arm projecting, in a first position, in front of the appliance housing in part and, in a second position, being received by the appliance housing, the at least one side arm comprising:
a first arm element having a first end and a second end, the first arm element being movably mounted in the appliance housing at the first end, and
a second arm element having a first end and a second end, the second arm element being movably mounted in the appliance housing at the first end and being movably connected to the second end of the first arm clement at the second end,
wherein the appliance housing has an underside, facing the surface to he cleaned, an upper side facing away from the surface to be cleaned, and a side wall connecting the upper side and the underside, the side wall including at least one opening for the at least one side arm, the at least one opening being defined by two lateral edges, wherein, when the at least one side arm is in the first position, the two arm elements of the at least one side arm and the two lateral edges of the at least one opening are approximately flush with one another.

2. The robotic vacuum cleaner according to claim 1, wherein the second ann element is slidingly mounted in the appliance housing at the first end.

3. The robotic vacuum cleaner according to claim 1, wherein a pin, which is slidingly mounted in a receiving portion in the appliance housing, is arranged on the first end of the second arm element.

4. The robotic vacuum cleaner according to claim 1, wherein both arm elements are interconnected at the second ends via a shaft.

5. The robotic vacuum cleaner according to claim 4, a brush element being arranged on the second ends of both arm elements of the at least one side arm, wherein the shaft between the first arm element and the second arm element simultaneously functions as a rotary shaft of the brush element.

6. The robotic vacuum cleaner according to claim 1, comprising elements arranged in the appliance housing for limiting rotational movement of the first arm element, wherein the rotational movement of the first arm element has, via limiting elements, an angular range of from 2 to 70 degrees.

7. The robotic vacuum cleaner according to claim 6, wherein the angular range is from 5 to 30 degrees.

8. The robotic vacuum cleaner according to claim 1, wherein the at least one side arm is spring-loaded towards the first position outside the appliance housing.

9. The robotic vacuum cleaner according to claim 8, wherein a spring force acting on the at least one side arm has a force of between 0.5 and 10 newtons.

10. The robotic vacuum cleaner according to claim 9, wherein the spring force is between 1.5 and 4 newtons.

11. The robotic vacuum cleaner according to claim 1, comprising a motor disposed on an outside of the first arm element, wherein the motor functions as a drive for the brush element of the at least one side arm via a toothed belt, a first pulley, and a second pulley, which are arranged within the first arm element.

12. A robotic vacuum cleaner for autonomously cleaning surfaces, the robotic vacuum cleaner comprising:
an appliance housing; and
at least one side arm which is movably mounted at least one of in or below the appliance housing and on which at least one brush element is disposed, the at least one side arm projecting, in a first position, in front of the appliance housing in part and, in a second position, being received by the appliance housing, the at least one side arm comprising:
a first arm element having a first end and a second end, the first arm element being movably mounted in the appliance housing at the first end; and
a second arm element having a first end and a second end, the second arm element being movably mounted in the appliance housing at the first end and being movably connected to the second end of the first arm element at the second end,
wherein both arm elements are interconnected at the second ends via a shaft, a brush element being arranged on the second ends of both arm elements of the at least one side arm, wherein the shaft between the first arm element and the second arm element simultaneously functions as a rotary shaft of the brush element.

13. A robotic vacuum cleaner for autonomously cleaning surfaces, the robotic vacuum cleaner comprising:
an appliance housing;
at least one side arm which is movably mounted at least one of in or below the appliance housing and on which at least one brush element is disposed, the at least one side arm projecting, in a first position, in front of the appliance housing in part and, in a second position, being received by the appliance housing, the at least one side arm comprising:

a first arm element having a first end and a second end, the first arm element being movably mounted in the appliance housing at the first end; and a second arm element having a first end and a second end, the second arm element being movably mounted in the appliance housing at the first end and being movably connected to the second end of the first arm element at the second end; and a motor disposed on an outside of the first arm element, wherein the motor functions as a drive for the brush element of the at least one side arm via a toothed belt, a first pulley, and a second pulley, which are arranged within the first arm element.

* * * * *